United States Patent [19]

Najarian

[11] 4,337,539

[45] Jul. 6, 1982

[54] NECKTIE KNOT SUPPORT ASSEMBLY

[76] Inventor: John Najarian, 257 Herbert Ave., Closter, N.J. 07624

[21] Appl. No.: 223,414

[22] Filed: Jan. 8, 1981

[51] Int. Cl.[3] ..... A41D 25/08; A41D 25/02

[52] U.S. Cl. ..... 2/153; 2/150

[58] Field of Search ..... 2/153, 152 A, 152 R, 2/145, 150

[56] References Cited

U.S. PATENT DOCUMENTS

| | | | |
|---|---|---|---|
| 3,221,343 | 12/1965 | Phillips et al. | 2/153 |
| 3,267,489 | 8/1966 | Phillips et al. | 2/153 |
| 3,336,600 | 8/1967 | Kanter et al. | 2/153 |
| 3,423,762 | 1/1969 | Spiegel et al. | 2/153 |
| 3,426,361 | 2/1969 | Ellin | 2/153 |
| 3,755,821 | 9/1973 | Tellone | 2/153 |

*Primary Examiner*—Richard J. Scanlan, Jr.
*Attorney, Agent, or Firm*—S. Stephen Baker

[57] ABSTRACT

A support and fastening means for producing a pre-tied necktie, using a modified form of body member and spring clamp thereon, in which the spring clamp and body member eliminate costly and expensive labor while producing a superior product. This result is accomplished by molding the body member with a horizontally slotted front arm which slidably receives the spring clamp, the body member and spring clamp further having complementary prong and opening means respectively, so formed as to inter-engage with a snap, and non-removable relationship. The body member further is molded with front positioning means for the spring clamp. In addition, a rear post for elevating or tilting the formed knot forwardly, or more horizontally, is also molded integrally with the body member for improving the appearance of the knot. As a result, it remains only necessary to snap the spring clamp into place without requiring any riveting or the like, while nevertheless producing a more firmly and better operating support assembly.

10 Claims, 9 Drawing Figures

FIG.6
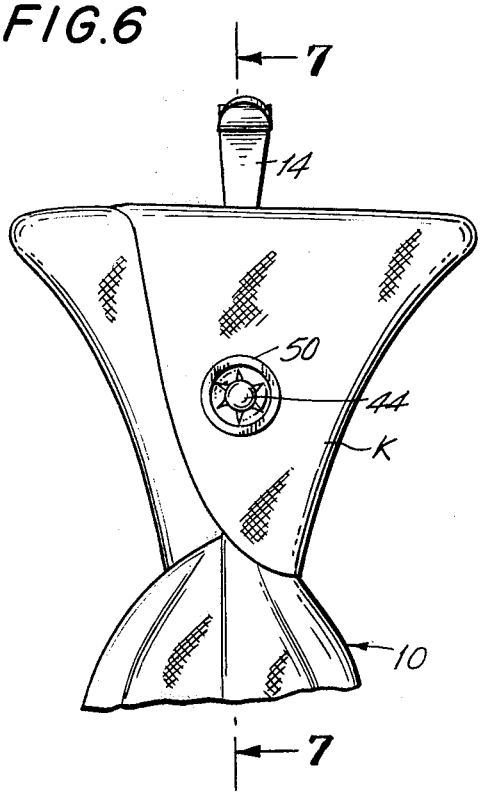
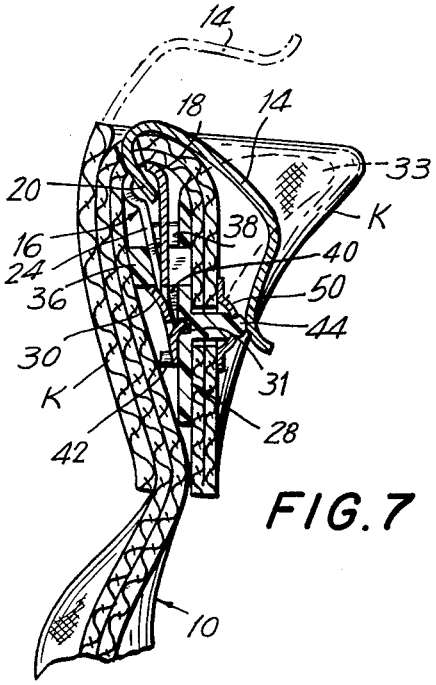
FIG.7
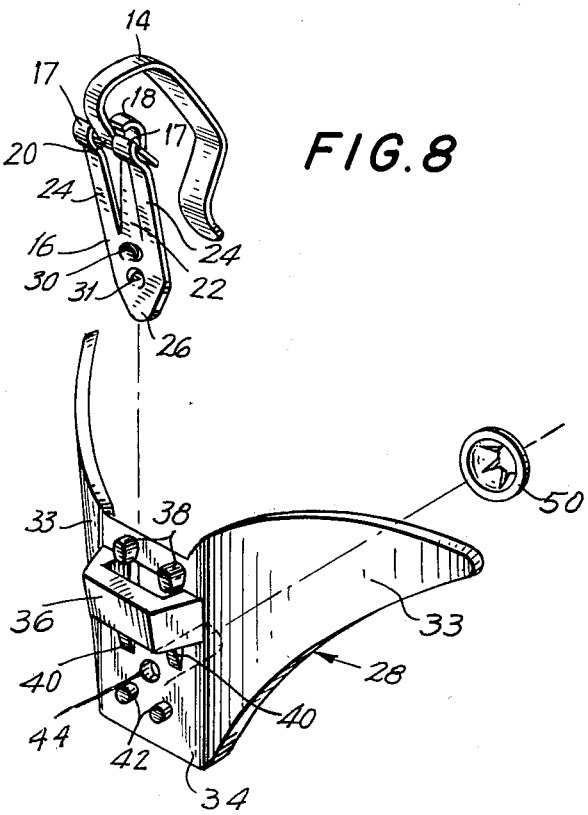
FIG.8
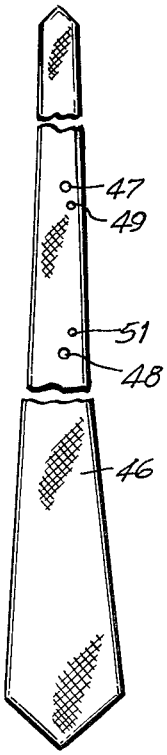
FIG.9

NECKTIE KNOT SUPPORT ASSEMBLY

BACKGROUND OF THE INVENTION

The present invention relates to improvements in necktie knot support assemblies which serve as a mechanical foundation for receiving and fixing of a fabric necktie, to be wrapped therearound, so that the ultimate composite product serves as a pre-tied necktie, with a spring clamp enabling the user to simply apply the pre-tied necktie to a shirt collar neckband or the like. The necktie is of course releasable and removable at will.

The broad idea is not new. Pre-tied neckties, to be inserted into place for wearing have been used for many decades. Such neckties provided with a spring clamp for firmly grasping the shirt neckband, have also been used and patented for more than twenty years. To my knowledge, such later spring clamp pre-tied neckties have been relatively complex, since they comprised, in addition to a plastic, forming body member, a metal spring clamp which required rivetting thereto, normally at the extreme lower end of the spring clamp which not only required somewhat skilled and laborious work, but nevertheless often resulted in an insecure and undesirably often lateral displacement likelihood of the metal spring clamp. This defect, referring to the support assembly alone, hampered the subsequent operations of the final assemblors of the finished pre-tied necktie and had other disadvantages.

Examples of such spring clamp pre-tied neckties are found in U.S. Pat. Nos. 2,798,226; 3,220,015; 3,222,684; 3,237,208; 3,336,600; 3,336,601; and 3,343,176. All these patents disclose and describe the basic nature of such later necktie assemblies. They further reveal the disadvantages which I have now discerned and have herein not only corrected but have produced a less expensive, less difficult and timeconsuming product, with superior results.

SUMMARY OF THE INVENTION

It is an object of the present invention to provide a necktie knot support assembly which comprises an improved basic knot forming body member, together with a spring clamp, and which eliminates skilled and laborious assembly operations of these two fundamental members.

Another object of the invention is to accomplish the above objective while further improving the assembly by firmly fixing and better stabilizing the two members, even without rivetting. To the contrary, I provide a spring clamp member which is simply manually applied. However, novel and effective attachment means are provided by a number of physical elements, which, in part, comprise, in the spring clamp structure, stamped attachment openings, while in the knot forming body member are provided molded spring clamp insertion and receiving means. Therefore, the assembly operation is essentially pre-determined mechanically so that the operator needs merely to slidably and snappably insert the members into position. A horizontally slotted guide and holding member is also provided.

Associated with the above objects, are that of providing complementary means on both members which prevent displacement, as by an undesirable lateral rotating or swinging motion of such assembled members, such as is common in a single rivetted assembly of the prior art. This invention forms the metal spring clamp member with barb-like prongs which serve to engage or intercept complementary receptors in the knot forming body. This eliminates relative vertical displacement, which a rivet could do, but I thus eliminate the rivet. Further, I provide molded side pins or projections on the knot forming body to confine and eliminate possible lateral swinging of the spring clamp member, which result is barely possible, if at all, when using a single rivet of a metal spring clamp member on and to a softer plastic knot forming body.

Further associated with the above objects is the simplification and multiple use of a rearwardly directed horizontal post on the knot forming body. Such a post is not broadly new. It is shown, for example, in U.S. Pat. No. 3,222,684, as a metal post, (although shown as extensible therein), which serves to elevate or urge the formed knot horizontally to improve its appearance as compared to a visually flattened knot which would reveal its old-fashioned pre-tied appearance, My invention molds the post on the body member, making integral what was formerly two-piece. However, this aspect per se is not its only advantage. I provide the inward forward end of the post with an opening which receives a spring clamp barb-like prong. Therefore, the molded post serves new and multiple functions in spite of its manufacturing facilitation.

Additional objects and advantages of the invention will be apparent from the following specification when taken in connection with the accompanying drawings, in which:

FIG. 6 is a rear elevational view of the complete pre-tied necktie, the lower fabric of the necktie being partly broken away, and the clamp arm being in upward, non-clamping position.

FIG. 7 is a cross-sectional view taken along the line 7—7 of FIG. 6.

FIG. 8 is an exploded perspective view of the knot forming assembly components; and FIG. 9 is an elevational fragmentary plan view of a conventional form of necktie advantageously employed with the improved device.

DETAILED DESCRIPTION

Figure 1:
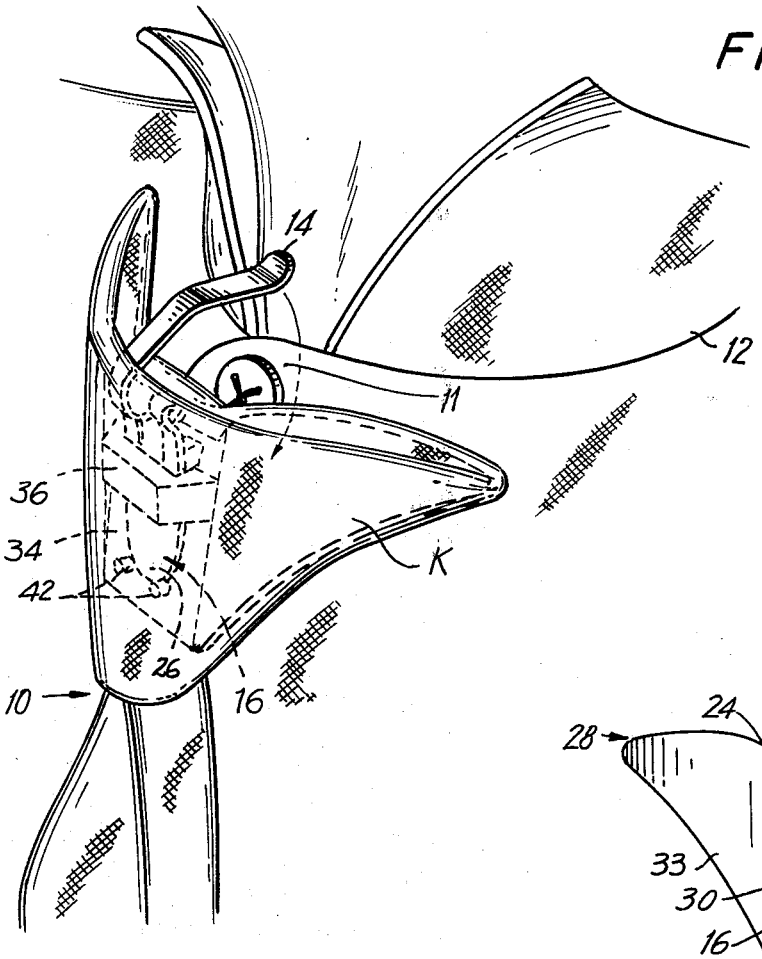
FIG. 1 is a front perspective view of a completely pre-tied necktie, the lower fabric being partly broken away, illustrating the application to a shirt neckband, the broken lines illustrating the knot forming support assembly of this invention.

Referring in detail to the drawings, there is shown in FIG. 1, the fully assembled pre-tied necktie 10, partly broken away at its bottom end. The formed knot K is attachable to, and releasable from, the neck band 11, of a shirt collar 12, the shirt collar being illustrated as being lifted for purposes of clarity, although normally it always remains in the conventional downward, wearing position.

Figure 5:
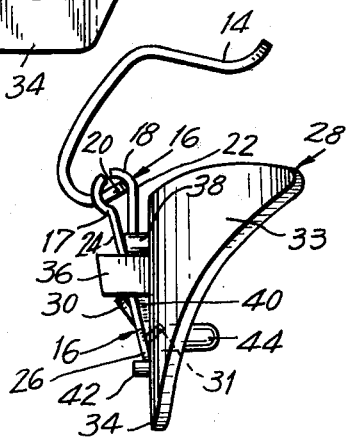
FIG. 5 is a side elevational view thereof, with the clamp arm 14 being in upward position.

The necktie 10 is applied to the neck band 11 by a swingable clamp arm 14 which forms the upper portion of a spring clamp 16. The upper portion of spring clamp 16 is not new, although the arm 14 is somewhat differently curved as compared to prior devices. As for such upper portion of clamp 16, it comprises the following conventional structure: The forward concave knuckles 17, and a rearward central knuckle 18; the rectangular cross-bar 20 which is integral with and forms the extreme inner end of clamp arm 14. These elements constitute means the swingably supporting the clamp arm 14 in a vertical plane since cross-bar 20 is received between knuckles 17 and 18, as shown in FIG. 5.

Knuckle 18 comprises the upper end of spring metal central leg 22 of the spring clamp 16, while both outer legs 24, integral with leg 22, although separated therefrom to provide composite clamping legs, terminate in knuckles 17. As above stated, these upper elements of spring clamp 16 are not new.

Figure 2:
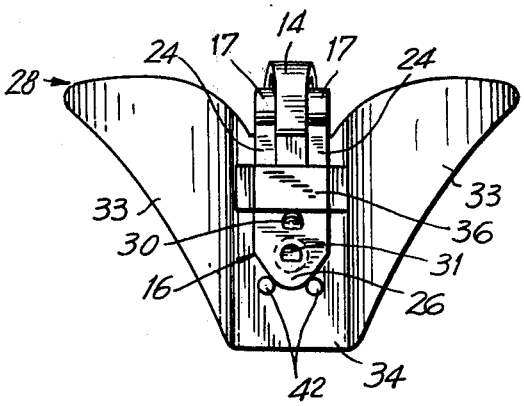
FIG. 2 is a front elevational view of the knot forming assembly itself.
Figure 3:
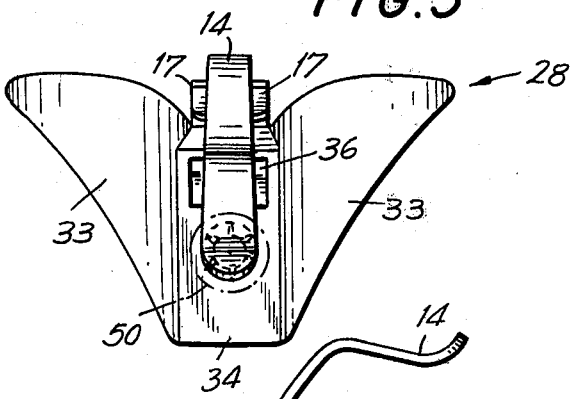
FIG. 3 is a rear elevational view thereof.
Figure 4:
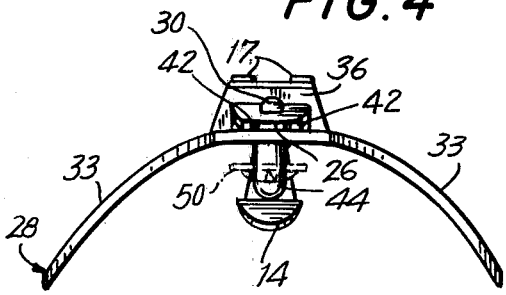
FIG. 4 is a bottom plan view thereof, the clamp arm 14 being in downward, clamping position.

However, the lower portion of spring clamp 16, as best shown in FIG. 8 and FIG. 2 has been transformed by my device, basically to eliminate the need for rivetting its bottom end or apex 26 to the main body member 28, while working together with other improvements to be described hereinafter. Thus, metal spring clamp 16 is stamped out to provide a first partial hole and outwardly extending integral prong 30. In essentially the same manner, a second partial hole, but inwardly extending integral prong 31 is formed. As will be hereinafter described, both prongs 30 and 31, additionally serve as barbs to fix the spring clamp 16 to body member 28, against accidental displacement therefrom. Said lower portion of said spring clamp is essentially flat. (For clarification purposes, in the claims herein, the term "one of said prongs" refers to prong 31, while "second prong" refers to prong 30.)

Referring now to the body member 28 which is generally shaped to determine the formation and appearance of the ultimate knot K, such body member 28 is normally fabricated by molding somewhat resilient polymer plastic material such as polyethylene or the like, or any substitute therefor whether metal or pressed fiber board, for example. It comprises conventional rearwardly directed side wings 33 connected by a central, relatively flat integral bridging wall 34. Wall 34 has been particularly devised herein to co-act with spring clamp 16 to achieve the desired results of this invention.

Referring again to FIG. 8, wall 34 is integrally formed in the molding process with a front horizontally slotted arm 36 for receiving the spring clamp 16, as shown in FIG. 5. The spring clamp 16, being of conventionally thin spring metal, is easily insertable and snappable into slotted arm 36. In order to provide better stabilizing, and as part of the stabilizing system, there are provided two molded integral short projections 38 which serve to press against the upper, outer legs 24 of clamp 16 when the clamp is inserted into position, said projections 38 being horizontally spaced.

Front wall 34 is also formed with downwardly tapered projections 40, directly below horizontal slotted arm 36, in order to enhance the stabilizing action by likewise bearing and pressing against inserted spring clamp 16. However projections 38 extend more forwardly than do tapered projections 40, so that spring clamp 16 assumes a slight forward angle of about 10 degrees relative to body member 28 as shown in FIG. 5, the tapered nature of projections 40 serving to stabilize this forward angle.

Further formed integrally with body member 28, and on wall 34, are two lowermost spaced pins or projections 42 which respectively bear against the sides of apex end portion 26, limiting further downward movement as shown in FIG. 2. These projections 42 further insure against lateral swinging of spring clamp 16 from the correct position which is shown in FIG. 2. Prevention of such lateral swinging, as above stated, is important to the final assemblors or the necktie to avoid a distorted knot.

As has been well known in the past, and has been described for example in U.S. Pat. No. 3,222,684, a rear post, (element 36 in that patent), projects outwardly for the purpose of urging or tilting the formed knot in an elevated manner so as to avoid a flattened, unaesthetic appearance of the knot. I have herein not only made such a post integrally molded with the body member, but have further shaped the inner end of the post to further increase the stabilized nature of the assembly.

Referring again to FIG. 8, the prong 31 is inwardly directed. This is also shown in FIG. 5 and FIG. 7. I provide a rear post 44 molded integrally with body member 28. However, referring to FIG. 7, I provide the extreme inner end of post 44 with an opening into which prong 31 enters, and then functioning like a barb or fish hook, cannot be accidentally dislodged since it tends to embed itself within said post opening. This is also indicated in FIG. 5. As a result of all the above simple attaching means, a remarkably stable support assembly is achieved, not only eliminating a rivet, but actually improving the performance, and requiring only a snapping motion.

The formation of the improved support assembly should now be evident. Referring to the exploded view of FIG. 8, the operator simply slides the spring clamp 16, through the horizontal slot of horizontal arm 36 as far as it will go. Many functions then take place virtually automatically.

Briefly; pins or projections 42 not only stop the sliding motion but laterally confine the spring clamp 16, as shown in FIG. 2. At the same time, upper projections 38, and tapered lower projections 40 urge the spring clamp into correct angular position. Prong 30 slidably passes through horizontal arm 36, but it cannot retreat as evident from FIG. 5 and FIG. 7. Prong 31 enters into the inner forward concavity, or opening of post 44 and cannot be dislodged. Stabilization then is essentially complete.

It now remains only to finally form and tie the necktie 46, shown in FIG. 9, to the essentially mechanical support assembly. As is conventional, necktie 46 is provided with uppermost, and lowermost larger holes 47 and 48. Inner, smaller holes 49 and 51 are also provided. Necktie 46 is shorter than conventionally tied neckties, being about 35 inches long. The final forming is conventional. Briefly, clamp arm 14 is first inserted into hole 47, and simultaneously post 44 is inserted into hole 49. Then, the necktie is wrapped horizontally around the wings 33, including the bridging wall 34. Finally after looping the necktie, the clamp arm 14 is inserted through hole 48, and simultaneously, the post 44 is inserted into hole 51, and pulled tight. All this is conventional, having been practiced by all such pre-tied necktie producers for more than ten years, by those skilled in the art.

At this time, the edges of the necktie knot sections overlap at the rear, as shown in FIG. 6. In order to avoid sewing, the so-called push-on speed nut 50, which has gripping teeth, is pushed tightly down over post 44 to complete the entire operation. This is conventional.

A preferred embodiment of my invention has been shown, but it is obvious that numerous changes and omissions may be made without departing from its spirit.

What I claim is:

1. A necktie knot support assembly for supporting a fabric pre-tied knotted necktie, said assembly comprising:

a main body member shaped to determine formation of the knot of said necktie, a spring clamp adapted to inter-engage said main body member, complementary means on said body member and said spring clamp, for snappably connecting and engaging said spring clamp to said body member while preventing dis-engagement therefor, said complementary means comprising barb-like projection means on said spring clamp, and receptor means on said body member which permit the inter-engagement of said spring clamp to said body member, and which prevent said dis-engagement, said receptor means receiving said barb-like projection means.

2. A necktie knot assembly according to claim 1 in which said barb-like projection means comprises two prongs integrally formed on said spring clamp, said spring clamp being of metal material, said body member being of relatively softer material, said body member receptor means comprising a spring clamp insertion and receiving slot formed thereon, and said receptor means further comprising a lower opening formed on said body member for receiving one of said prongs.

3. A necktie knot assembly according to claim 2 in which said body member is molded of polymer plastic material, a rearwardly extending post being molded integrally therewith, and said receptor means opening being formed on the inward, forward end of said post.

4. A necktie knot assembly according to claim 2 in which said body member is molded of polymer plastic material, a second one of said prongs being outwardly projected, a substantially horizontal arm integrally formed on said body member and in which said insertion and receiving slot is formed, said second prong being directly below said horizontal arm and preventing vertical disengagement of said spring clamp from said body member.

5. A necktie knot assembly according to claim 4 and including a rearwardly directed extending post molded integrally with said body member, and said receptor means opening being formed on the inward, forward end of said post for receiving said one of said prongs.

6. A necktie assembly according to claim 5 and wherein said one of said prongs, being barb-like, tends to embed itself in said post inward, forward end so as to resist disengagement of said prong from said post.

7. A necktie knot assembly according to claim 4 and including projection means integrally formed on the front face of said body member immediately above said horizontal arm, said integral body member projection means pressing the upper end of said spring clamp forwardly.

8. A necktie knot assembly according to claim 7 and wherein said integral body member projection means comprises two horizontally spaced projections.

9. A necktie knot assembly according to claim 8 and including downwardly tapered projection means integrally formed on said body member for imparting, in cooperation with said two horizontally spaced projections, a forwardly angular relationship of said spring clamp relative to said body member, said tapered projection means extending forwardly on said body member, less than do said two horizontally spaced projections for imparting said angular relationship.

10. A necktie knot assembly according to claim 9 and including lowermost projections integrally formed on the front face of said body member, said lowermost projection comprising two horizontally spaced projections, between which the lower end of said spring clamp is disposed, said spaced lowermost projection bearing against the side edges of said spring clamp so as to prevent side-wise displacement of said spring clamp.

* * * * *